US008979664B1

(12) United States Patent
Kovacs

(10) Patent No.: US 8,979,664 B1
(45) Date of Patent: Mar. 17, 2015

(54) SLIP PREVENTING GOLF GRIP ACCESSORY

(71) Applicant: Edward J. Kovacs, Vandalia, OH (US)

(72) Inventor: Edward J. Kovacs, Vandalia, OH (US)

( * ) Notice: Subject to any disclaimer, the term of this patent is extended or adjusted under 35 U.S.C. 154(b) by 0 days.

(21) Appl. No.: 14/162,022

(22) Filed: Jan. 23, 2014

(51) Int. Cl.

| | |
|---|---|
| ***A63B 69/36*** | (2006.01) |
| ***A63B 59/00*** | (2006.01) |
| ***A63B 57/00*** | (2006.01) |
| ***A63B 53/16*** | (2006.01) |

(52) U.S. Cl.
CPC ..... *A63B 59/0029* (2013.01); *A63B 57/00* (2013.01); *A63B 53/16* (2013.01)
USPC ..... 473/206; 473/201

(58) Field of Classification Search
USPC ..... 473/201, 203, 205, 206
See application file for complete search history.

(56) References Cited

U.S. PATENT DOCUMENTS

| | | | | |
|---|---|---|---|---|
| 855,016 | A * | 5/1907 | Orthwein | 473/206 |
| 2,780,464 | A * | 2/1957 | Ashley | 473/206 |
| 2,928,678 | A * | 3/1960 | Cutting | 473/206 |
| 4,651,991 | A | 3/1987 | McDuff | |
| 5,118,107 | A | 6/1992 | Bucher | |
| 5,203,390 | A | 4/1993 | Eckstein | |
| 5,524,885 | A | 6/1996 | Heo | |
| 6,385,817 | B1 | 5/2002 | Johnson | |
| 6,945,874 | B2 * | 9/2005 | Kelly | 473/201 |
| 7,261,639 | B2 | 8/2007 | Smith et al. | |
| 7,886,787 | B1 | 2/2011 | Wilson | |
| 7,887,428 | B2 * | 2/2011 | Kurisu | 473/206 |
| 2004/0166949 | A1 | 8/2004 | Smith et al. | |

* cited by examiner

*Primary Examiner* — Nini Legesse
(74) *Attorney, Agent, or Firm* — Paul R. Martin

(57) ABSTRACT

An accessory for a golf club to assist in the grip of the golf club and prevent the club from slipping out of the user's hands, especially when the grip is wet. The accessory is slid onto the grip portion of the golf club.

6 Claims, 3 Drawing Sheets

SLIP PREVENTING GOLF GRIP ACCESSORY

TECHNICAL FIELD OF THE INVENTION

The present invention relates to the general art of golf, and to the particular field of golf equipment.

BACKGROUND OF THE INVENTION

It is well known in the golfing industry that a player's hand grip on the golf club shall grip must be light rather than strong to allow the wrists of the player to rotate freely through the swing for squaring the club face to the ball at the point of impact, and to maximize the club head speed which controls the distance and direction of the ball. However, if a player strengthens his or her hand grip during wet weather conditions to prevent slippage of the club, the result will 25 impede the wrist rotation and therefore prevent the squaring of the club face at impact, resulting in misdirection of the golf ball as well as decreasing the distance the ball travels.

Conventional golf club grips is their tendency to become slippery when dampened, as for example, when playing under rainy conditions or by contact with perspiration formed on the golfer's hands. Slippery contact of a golfer's hands with a golf club grip reduces his feel of the golf club. Conventional golf club grips are made of a hard material which fails to provide adequate shock absorbing qualities.

In view of the above, there is a need for a device capable of reducing the risk of a player's hands slipping off a golf club grip while executing a golf swing in wet weather conditions, or for golfers such as seniors with very weak grips. This accessory works with either right handed or left handed golfers.

SUMMARY OF THE INVENTION

The above-discussed disadvantages of the prior art are overcome by an accessory for a golf club to assist in the grip of the golf club and prevent the club from slipping out of the user's hands, especially when the grip is wet. The accessory is slid onto the grip portion of the golf club.

The present invention provides a method and accessory for reducing the risk of a player's hands slipping off a wet golf club grip while executing a golf swing. The accessory is adapted to be installed on a golf club shaft and secured to the grip without requiring any modification of the club. The accessory is also configured to be removed from the golf club when its use is not required.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
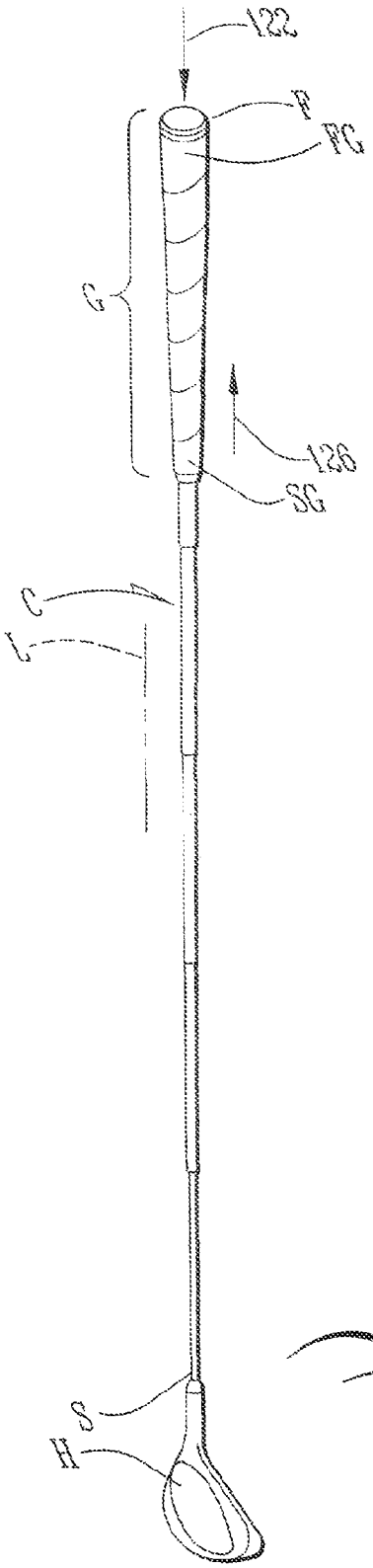
Fig. 1 ( PRIOR ART )
FIG. 1 is a perspective view of a prior art golf club.
Figure 2:
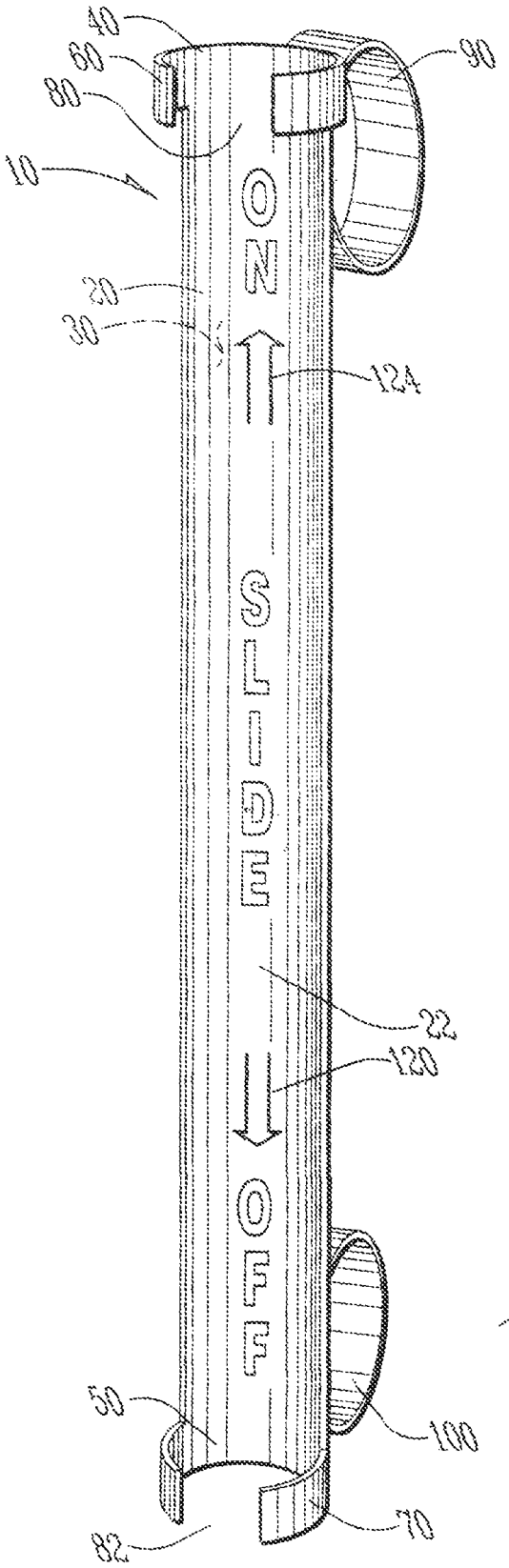
FIG. 2 is a front perspective view of an accessory for use on a golf club to prevent a golfer's hands from slipping in wet conditions.
Figure 3:
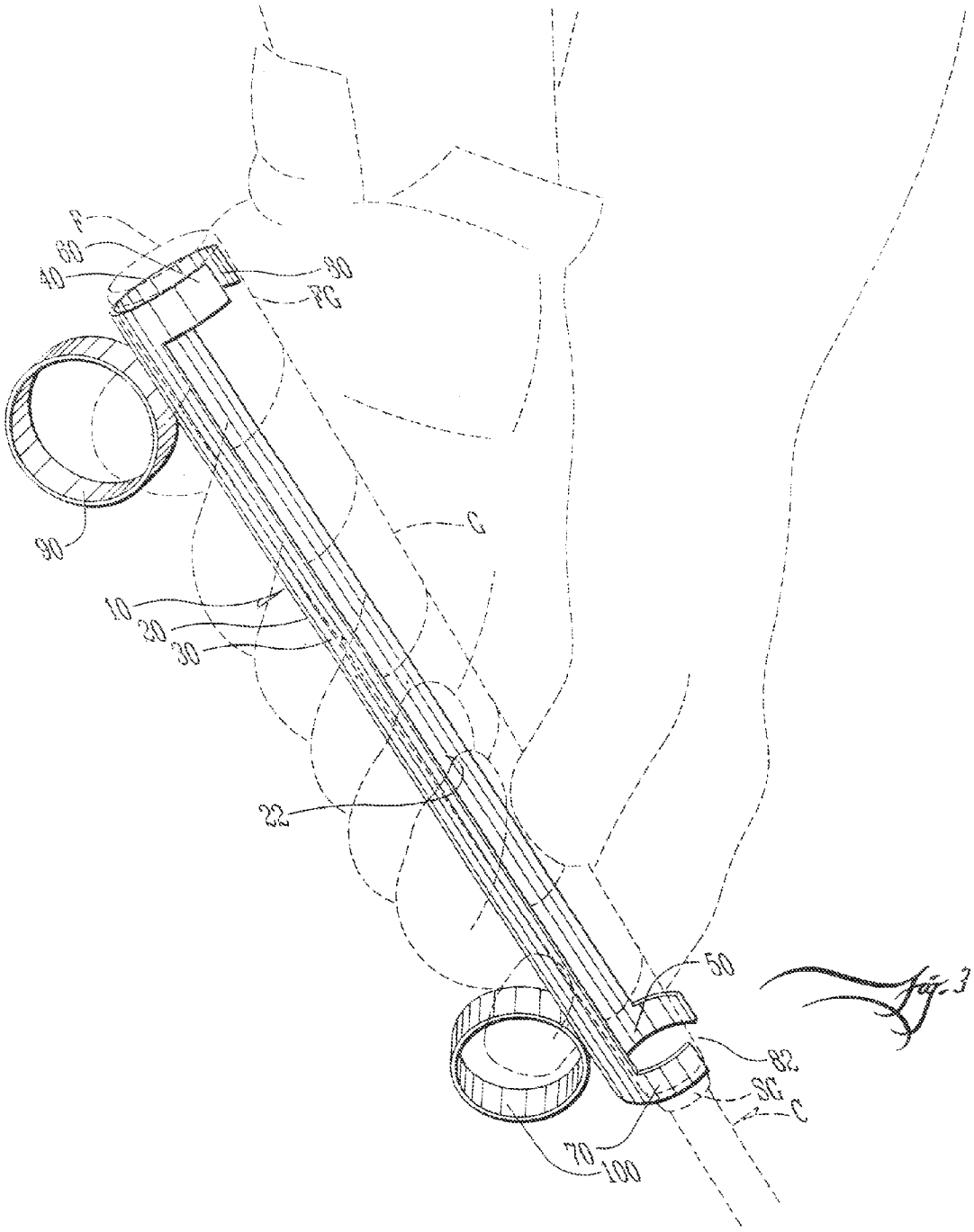
FIG. 3 is a rear perspective view of an accessory for use on a golf club to prevent a golfer's hands from slipping in wet conditions, or a golfer having a weak grip. As shown, the view is shown in connection with a left handed golfer, but the accessory can also be equally used by a right handed golfer

Referring to the figures, it can be understood that the present invention is embodied in a golf accessory 10 which is slidably fit onto a grip of a golf club to prevent the club from slipping out of the user's hands, especially in wet weather. The accessory of this invention is mountable on a golf club, such as golf club C shown in FIG. 1, having a shaft S with oppositely-disposed first and second ends F and S respectively which are spaced apart along a longitudinal axis L of the club, a grip portion G at the first end of the shaft, and a head H at the second end of the shaft. The golf club grip has a first grip portion FG and a second grip portion SG located closer to the second end of the shaft than the first grip portion, and the grip can be tapered so that the second grip portion has a smaller diameter than the first grip portion.

Accessory 10 includes a body 20 which is C-shaped and has an inner concave surface 22 that is sized and shaped to snugly abut the outer surface of a golf club grip portion G when the accessory is in use. Body 20 also has an outer convex surface 30. Accessory body 20 has a first end 40 which will be a top end when the accessory is in use and a second end 50 which will be a bottom end when the accessory is in use.

A first C-shaped clamp 60 is unitary with the body and is located at the first end 40 of the body adjacent to the inner surface of the body and a second C-shaped clamp 70 is unitary with the body and is located at the second end 50 of the body adjacent to the inner surface of the body. The clamps 60 and 70 have open areas 80 and 82 respectively to fit around the golf club grip as will be understood from the teaching of this disclosure and are sized and shaped to slidably accommodate the grip portion of the golf club when the accessory is in place on the golf club.

A first annular ring 90 is unitary with the body and is located at the first end 40 of the body adjacent to the outer surface of the body and a second annular ring 100 is unitary with the body and is located at the second end 50 of the body adjacent to the outer surface of the body.

The first and second clamps are flexible to assume a flexed size and a gripping size, with the flexed size being sized to slidably accommodate the golf grip of the golf club and the gripping size being sized to frictionally grip the golf club grip to fixedly mount the accessory on the golf club grip.

Accessory 10 is used whenever there is a chance that a golf club will slip during use, such as in wet weather, or in an instance when the golfer's grip is weak. Accessory 10 is removed from the club at other times. When the accessory is to be used, it is positioned adjacent the golf club first end F with second clamp 70 located immediately adjacent to that end. The accessory is then moved in direction of arrows 120 and 122 and slid onto the golf club grip from first grip portion FG over first end F in the direction of the longitudinal axis L of the golf club until both clamp 60 and clamp 70 are securely seated on the golf club to frictionally mount the accessory onto the club grip. The clamps flex radially outward to permit this sliding placement of the accessory, and then flex radially inward to frictionally mount the accessory onto the club. The flexibility of the clamps permits them to accommodate the golf club grip even if the outer diameter of the golf club grip differs at one end thereof from the other end thereof. When the accessory is in place, the golfer can grip the club and the accessory and his or her hands will be prevented from slipping off the grip by abuttingly engaging the rings 90 or 100. This is accomplished by inserting his or her pinkie (little) finger into ring 90, and his or her index finger into ring 100. The accessory can be sized to match the length of a golf grip or be shorter than the golf grip as desired. The accessory can be longer than the total size of the golfer's grip or be approximately, the same size as that golfer's grip when the club is gripped. The accessory is moved off of the grip for storage by sliding it in directions 124 and 126 until clamp 70 clears first end F of the grip. As previously stated, the accessory is adaptable for use with either right handed or left handed golfers.

Swing speeds of golfers vary from player to player. During the swing forces are attempting to pull the club from the player's hands. The accessory 10 is counter acting this force, with the index finger of one hand inserted in the lower ring 100 and the little finger of the other hand in the top ring 90. The C clamps 60 and 70 grip the club tighter when the swing is either faster or harder due to the taper of the club grip. Used properly, the club cannot leave the player's hand even with minimal force on the hand hold.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. An accessory for a golf club to prevent the club from slipping in a golfer's hands, the accessory comprising:

A) an elongated semi-tubular C-shaped body having a length substantially the same as a golf club grip section, and (1) an inner concave surface that is sized and shaped to snugly abut an outer surface of a golf club grip portion when the accessory is in use, (2) an outer convex surface, and (3) a first end which will be a top end of said C-shaped body when the accessory is in use, (4) a second end which will be a bottom end of said C-shaped body when the accessory is in use, B) a first C-shaped clamp which is unitary with the C-shaped body and is located at the first end of the body adjacent to the inner surface of the body, the first C-shaped clamp having an open area which is sized to accommodate the golf club grip during application of the body t0o the golf club grip for use;

C) a second C-shaped clamp which is unitary with the C-shaped body and is located at the second end of the body adjacent to the inner surface of the body, the second C-shaped clamp having an open area which is sized to accommodate the golf club grip during application of the body to the golf club grip for use;

D) the clamps being sized and shaped to slidably accommodate the grip portion of the golf club when the accessory is in place on the golf club;

E) a first annular ring which is unitary with the C-shaped body and is positioned on the underside of the outer surface of said body at the first end thereof; and F) a second annular ring which is unitary with the C-shaped body and is positioned on the underside of the outer surface of said body at the second end thereof, said first and second annular rings being aligned on the same longitudinal axis.

2. The accessory defined in claim 1 wherein the first and second clamps are flexible to assume a flexed size and a gripping size, with the flexed size being sized to slidably accommodate the golf grip of the golf club and the gripping size being sized to frictionalloy grip the golf club to fixedly mount the accessory on the golf club grip.

3. An accessory for a golfclub to prevent the club from slipping in a golfer's hands, the accessory comprising:

A) An elongated semi-tubular C-shaped body having a first end, a second end, an inner surface and an outer surface;

B) a first C-shaped clamp located at the first end of the body adjacent to the inner surface of the body;

C) a second C-shaped clamp located at the second end of the body adjacent to the inner surface of the body;

D) the clamps being sized and shaped to slidably accommodate the grip portion of the golf club when the accessory is in place on the golf club;

E) a first annular ring positioned on the underside of the first end of the body adjacent to the outer surface of the body; and F) a second annular ring positioned on the underside of the second end of the body adjacent to the outer surface of the body, said first and second annular rings being aligned on the same longitudinal axis.

4. The accessory defined in claim 3 wherein the first and second clamps are flexible to assume a flexed size and a gripping size, with the flexed size being sized to slidably accommodate the golf grip of the golf club and the gripping size being sized to frictionally grip the golf club grip to fixedly mount the accessory on the golf club grip.

5. An accessory for a golf club to prevent the club from slipping in a golfer's hands, the accessory comprising:

A) an elongated semi tubular body having a first end, a second end, an inner surface and an outer surface;

B) a first golf grip engaging element located at the first end of the body adjacent to the inner surface of the body;

C) a second golf grip engaging element located at the second end of the body adjacent to the inner surface of the body;

D) a first hand-abutting end element located on an underside of said body at the first end of the body adjacent to the outer surface of the body; and E) a second hand-abutting element located on an underside of said body at the second end of the body adjacent to the outer surface of the body, said first and second hand-abutting elements being aligned on the same longitudinal axis, F) the hand-abutting elements abutting a golfer's hands to prevent the golfer's hands from slipping off of the body when the accessory is in use.

6. The accessory defined in claim 5 wherein the first and second golf grip engaging elements are flexible to assume a flexed size and a gripping size, with the flexed size being sized to slidably accommodate a golf grip of a golf club and the gripping size being sized to frictionally grip the golf club grip to fixedly mount the accessory on the golf club grip.

* * * * *